US006668418B2

(12) United States Patent
Bastien

(10) Patent No.: US 6,668,418 B2
(45) Date of Patent: Dec. 30, 2003

(54) SQUEEGEE IMPLEMENT

(76) Inventor: Daniel Bastien, 4354 De la Sittelle, Cap-Rouge, QBC (CA), G1Y 2H5

( * ) Notice: Subject to any disclaimer, the term of this patent is extended or adjusted under 35 U.S.C. 154(b) by 185 days.

(21) Appl. No.: 10/051,147

(22) Filed: Jan. 22, 2002

(65) Prior Publication Data

US 2003/0135942 A1 Jul. 24, 2003

(51) Int. Cl.[7] ..... A47L 13/11; A47L 1/06
(52) U.S. Cl. ..... 15/245; 15/121
(58) Field of Search ..... 15/121, 245

(56) References Cited

U.S. PATENT DOCUMENTS

| | | | | |
|---|---|---|---|---|
| 206,212 A | * | 7/1878 | Balch | 15/245 X |
| 496,619 A | * | 5/1893 | Ruffing | 15/245 |
| 956,566 A | * | 5/1910 | Brown | 15/245 |
| 1,500,274 A | * | 7/1924 | Scarling | 15/245 |
| 5,184,372 A | | 2/1993 | Mache | |
| 5,347,676 A | | 9/1994 | Saitoh | |
| 5,349,716 A | | 9/1994 | Millar | |
| 5,539,949 A | | 7/1996 | Stanton | |
| 5,809,605 A | | 9/1998 | Gringer | |
| 5,970,560 A | | 10/1999 | Leroux | |
| 6,092,255 A | | 7/2000 | Kim | |

* cited by examiner

*Primary Examiner*—Mark Spisich

(57) ABSTRACT

A squeegee implement for attachment to a conventional squeegee including a squeegee handle and a wiping blade. The implement includes an absorbing component for absorbing a portion of the liquid having been wiped from a surface by the wiping blade. The implement also includes an attachment structure for attaching the absorbing component to the squeegee adjacent the wiping blade so as to allow the absorbing component to absorb liquid emanating from the wiping blade. The squeegee implement further includes a guiding structure in fluid communication with both the wiping blade and the absorbing component for guiding the liquid from the wiping blade to the absorbing component. Guiding and absorbing components prevent liquid wiped with the blade from falling back on the wiped surface.

26 Claims, 3 Drawing Sheets

SQUEEGEE IMPLEMENT

FIELD OF THE INVENTION

The present invention relates to the general field of training equipments and is particularly concerned with squeegee implement.

BACKGROUND OF THE INVENTION

The prior art is replete with various types of tools for cleaning windows and other types of relatively smooth surfaces. A particularly common cleaning tool for such purpose is the tool commonly referred to as a squeegee. The typical squeegee has a generally elongated handle and a transverse head. The head is typically provided with a sponge-like pad along one edge thereof and a relatively flexible squeegee blade along an opposed edge thereof. Cleaning fluid is applied to the exterior surface about to be cleaned. The liquid is typically applied by immersing the pad in the cleaning liquid and drawing the latter across the surface to be cleaned. Subsequently, the squeegee blade is wiped across the wetted surface to remove dust, debris and the like along with the cleaning liquid.

The conventional squeegee-type tools are relatively efficient in certain settings such as when used on the relatively flat exterior surface readily accessible both to apply the cleaning liquid thereto and to remove the fluid and debris therefrom. However, conventional squeegee-type tools are relatively ineffective and provide relatively unsatisfactory results. In other settings such as for example when the surface to be cleaned is curved or located in a relatively restricted area.

In such settings, the unsatisfactory results of conventional squeegee-type devices include incomplete wiping and/or streaks due to the unmatched configuration of the blade and surface to be cleaned. Furthermore, the incompletely wiped cleaning liquid often drips onto adjacent surfaces creating a messy situation.

One particularly common example of a setting in which conventional squeegee-type tools are ineffective is the cleaning of the inner surfaces of vehicle windshields, inside house windows and the like. The concave configuration of the windshields in conjunction with the relatively restricted space adjacent to the windshield borders render the cleaning operation difficult. Accordingly, the cleaning liquid is often not satisfactorily wiped-off the inner surface of the windshield resulting in the presence of unwanted streaks on the windshield and in the dripping of cleaning liquid onto the dashboard and other adjacent surfaces.

One of the possible reasons for the hereinabove mentioned unsatisfactory results in certain settings is that as the conventional squeegee blade wipes a surface, the cleaning liquid swept up by the blade sequentially transfers from the lower or wiping edge portion of the blade to the upper end portion thereof. It is gathered at that location before being transferred or recovered at the edge of the surface being cleaned or into a suitable container. However, in difficult settings, the recovery percentage of the cleaning liquid is poor.

Problems associated with the poor percentage of cleaning liquid recovery with conventional squeegee-type tools have been recognized in the prior art. Various solutions have been proposed. One particular type of solution is to use a vacuum-assisted squeegee attachment along with conventional squeegee-type tools. An example of such a solution is disclosed in U.S. Pat. No. 5,184,372 naming Gerard R Mache as inventor and issued Feb. 9, 1993. The squeegee attachment tools are designed for attachment to a vacuum cleaner. Such tools are typically provided with a housing connectable to a vacuum source at one end, with an oblong suction head fitted with a narrow intake port for increasing suction pressure at the other end and a resilient squeegee-type blade in proximity to the intake port. In operation, such tools are wiped across the surface to be cleaned which has been previously wetted with a cleaning solution drawing liquid and foreign debris towards the intake port as the vacuum source aspirates the material.

Although theoretically appealing, this type of solution is associated with various drawbacks. Typically, this type of structure is relatively adequate for bulk removal of liquids but falls short of the intended purpose and leave a considerable quantity of liquid, debris and cleaning solution on or adjacent of the surface they are intended to clean. Furthermore, they are relatively large and bulky and are relatively difficult to operate. Also, some known devices retain liquid on the squeegee blades and drips it back onto cleaned areas when lifted from the cleaning surface. These prior art devices also require the purchasing and maintenance of vacuum-providing devices. In view of the inadequacies related to prior art devices there still exists a need for an improved squeegee and/or squeegee implement.

SUMMARY OF THE INVENTION

It is therefore a general object of the present invention to provide an improved squeegee and/or squeegee implement.

An advantage of the present invention includes that the proposed squeegee and/or squeegee implement allows for cleaning of glass and other relatively smooth surfaces with reduced risks of creating streaks thereon. Also, the proposed tool allows for the cleaning of various types of surfaces including curved surfaces, angled surfaces and the like with reduced risks of having cleaning liquid dripped onto adjacent surfaces.

Furthermore, the proposed tool allows an intended user to wipe cleaning liquid off a window to be cleaned while moving the tool wiping blade in various angular relationships relative to the surface being cleaned, such as up-side-down on greenhouse internal surfaces, without increase risks of creating streaks or having liquid dripped onto adjacent surfaces. Still further, the proposed tool allows for cleaning of surfaces through a set of easy and ergonomical steps.

Furthermore, the proposed tool allows for absorption of the cleaning liquid thus not only reducing the risks of having cleaning liquid dropped onto adjacent surfaces but also reducing the number of operational steps required for cleaning a given surface. The proposed tool thus allows for a reduction in the required cleaning time for cleaning a given surface as compared with the time required for cleaning the same surface with a conventional cleaning tool.

Still furthermore, the proposed tool allows for absorption of the cleaning liquid from the wiped surface and from the wiping blade in predetermined absorbent components that can be readily replaced without requiring special tooling or manual dexterity through a set of easy and ergonomical steps.

The proposed tool may be built integrally as a new type of squeegee structure or, in the case wherein it is provided as a squeegee implement may be easily retrofitted onto conventional squeegee structures.

In accordance with the present invention, there is provided an implement for attachment to a squeegee, the squeegee including a squeegee handle and a wiping blade attached to the handle, the squeegee allowing a liquid to be wiped-off a surface, the squeegee implement comprising: an absorbing means for absorbing at least a portion of the liquid having being wiped from the surface by the wiping blade; an attachment means for attaching the absorbing means to the squeegee adjacent the wiping blade so as to allow the absorbing means to absorb the liquid; and a guiding means in fluid communication with both the wiping blade and the absorbing means for guiding the liquid from the wiping blade to the absorbing means.

Preferably, the attachment means is a releasable attachment means for releasably attaching the absorbing means to the squeegee. Conveniently, the absorbing means includes an absorbent component made of an absorbent material. Preferably, the absorbent material is a spongious material. Conveniently, the absorbing component defines an absorbent component outer surface and wherein a generally liquid impervious shell is attached to a section of the absorbing component outer surface. Preferably, the shell is made out of a substantially rigid material.

Conveniently, the attachment means includes a retaining structure attached to the squeegee intermediate the handle and the wiping blade, the retaining structure being configured and sized for retaining at least a portion of the absorbent component.

Preferably, the wiping blade has a generally elongated configuration defining a blade first main surface, a blade second main surface, a blade wiping edge, an opposed blade attachment edge and a pair of blade side edges, the retaining structure defining a retaining structure main wall, the retaining structure main wall having a generally flat configuration defining a main wall first surface, a main wall second surface, a main wall first attachment edge, an opposed main wall second attachment edge, a main wall first side edge and an opposed main wall second side edge, the blade attachment edge being attached to the main wall first attachment edge with the wiping blade and the retaining structure main wall in a generally coplanar relationship relative to each other.

Conveniently, the implement further comprises a retaining bracket extending from the retaining structure main wall, the retaining bracket being configured and sized for frictionally retaining the absorbent component against the main wall first surface. Preferably, the absorbent component has a generally parallelepiped-shaped configuration defining a absorbent component first main surface, an absorbent component second main surface, an absorbent component first auxiliary surface, an absorbent component second auxiliary surface, an absorbent component first side surface and an absorbent component second side surface; the retaining bracket having a generally L-shaped configuration defining a bracket first leg and a generally perpendicular bracket second leg, the bracket first leg extending generally perpendicularly from the retaining structure main wall adjacent the main wall first side edge, the retaining bracket being configured and sized so that the absorbent component is frictionally retained by the retaining structure with the absorbent component first main surface frictionally abutting against the main wall first surface and the bracket second leg frictionally abutting against the absorbent component second main surface.

Conveniently, the implement further comprises a retaining door, the retaining door having a generally L-shaped configuration defining a door first leg and a generally perpendicular door second leg, the door first leg being pivotally attached to the retaining structure main wall adjacent the main wall second side edge so as to be pivotable between a door open configuration wherein the door first leg allows insertion of the absorbent component in the retaining structure and a door closed configuration wherein the door first leg prevents withdrawal of the absorbent component from the retaining structure, the retaining door being configured and sized so that when the retaining door is in the door closed configuration and the absorbent component is frictionally retained in the retaining structure at least a portion of the absorbent component first main surface frictionally contacts the main wall first surface and at least a portion of the absorbent component second main surface frictionally contacts the door second leg.

Preferably, the absorbent component is sized so as to be in a generally compressed state at locations wherein the absorbent component is frictionally retained by the door and bracket second legs.

In accordance with one embodiment of the invention, the absorbent component has a generally parallelepiped-shaped configuration defining an absorbent component first main surface, an absorbent component second main surface, an absorbent component first auxiliary surface, an absorbent component second auxiliary surface, an absorbent component first side surface and an absorbent component second side surface; the attachment means including a first strip of miniature hook-and-loop fiber secured to the main wall first surface and a second strip of miniature hook-and-loop fiber secured to the absorbent component first main surface, the first and second strips of miniature hook-and-loop fiber being configured, sized and positioned so as to be substantially in register with each other when the absorbent component is attached to the retaining structure main wall whereby the first and second strips of miniature hook-and-loop fiber cooperate with each other for releasably securing the absorbent component to the main wall first surface.

In accordance with another embodiment of the invention, the implement further comprises a handle attachment wall extending from the retaining structure main wall adjacent the main wall second attachment edge, the handle extending outwardly from the handle attachment wall. Preferably, the retaining structure also includes a retaining structure auxiliary wall extending from the handle attachment wall so as to be in a generally spaced relationship relative to the retaining structure main wall and to define a retaining structure wall spacing therebetween, the absorbent component being slidably insertable in the retaining wall spacing and frictionally retained between the retaining structure main and auxiliary walls once inserted in the retaining structure wall spacing.

In one embodiment of the invention, at least a section of the handle has a generally hollow configuration defining a handle hollow section and wherein the absorbing means further includes an absorbent insert inserted into the handle hollow section, the absorbent insert being made of an absorbent material and being in fluid communication with the absorbent component.

Conveniently, the guiding means includes a generally elongated guiding protrusion extending from the blade towards the absorbing means. Preferably, the guiding protrusion is made out of a wick component for providing a capillary action.

In one embodiment of the invention, the wiping blade has a generally elongated, rectangular and flat configuration defining a blade first main surface, a blade second main surface, a blade wiping edge, an opposed blade attachment edge and a pair of blade side edges and wherein the retaining structure defines a retaining structure main wall, the retaining structure main wall having a generally rectangular and flat configuration defining a main wall first surface, a main wall second surface, a main wall first attachment edge, an opposed main wall second attachment edge, a main wall first side edge and an opposed main wall second side edge, the blade attachment edge being attached to the main wall first attachment edge with the wiping blade and the retaining structure main wall in a generally coplanar relationship relative to each other, the wick component being secured to both the blade first main surface and the main wall first surface so as to extend from a wick first position located adjacent the blade wiping edge to a wick second position wherein the wick component is sandwiched between the main wall first surface and the absorbing means.

In accordance with another embodiment of the invention, the wiping blade has a generally elongated configuration defining a blade first main surface, a blade second main surface, a blade wiping edge, an opposed blade attachment edge and a pair of blade side edges, the retaining structure defining a retaining structure main wall, the retaining structure main wall having a generally flat configuration defining a main wall first surface, a main wall second surface, a main wall first attachment edge, an opposed main wall second attachment edge, a main wall first side edge and an opposed main wall second side edge, the blade attachment edge being attached to the main wall first attachment edge with the wiping blade and the retaining structure main wall in a generally coplanar relationship relative to each other; wherein the guiding means includes a main guiding protrusion and a pair of auxiliary guiding protrusions, the main and auxiliary guiding protrusions extending from a protrusion first position located adjacent the blade wiping edge to a protrusion second position wherein the main and auxiliary guiding protrusions are sandwiched between the main wall first surface and the absorbing means, the main guiding protrusion extending in a generally perpendicular relationship relative to the blade wiping edge, the auxiliary guiding protrusions being in a generally proximate relationship relative to the main guiding protrusion adjacent the protrusion second position and diverging away from each other in a direction leading towards the blade wiping edge.

Preferably, the main and auxiliary guiding protrusions defining a pair of sidemost guiding protrusions adjacent the pair of blade side edges, each sidemost guiding protrusion runs along a corresponding blade side edge.

In accordance with yet another embodiment of the invention, the wiping blade has a generally elongated configuration defining a blade first main surface, a blade second main surface, a blade wiping edge, an opposed blade attachment edge and a pair of blade side edges, the retaining structure defining a retaining structure main wall, the retaining structure main wall having a generally flat configuration defining a main wall first surface, a main wall second surface, a main wall first attachment edge, an opposed main wall second attachment edge, a main wall first side edge and an opposed main wall second side edge, the blade attachment edge being attached to the main wall first attachment edge with the wiping blade and the retaining structure main wall in a generally coplanar relationship relative to each other; wherein the guiding means includes a main guiding groove and a pair of auxiliary grooves formed on the blade first main surface, the main and auxiliary guiding grooves extending from a groove first position located adjacent the blade wiping edge to a groove second position wherein the main and auxiliary guiding grooves are in fluid communication with the absorbing means, the main guiding groove extending in a generally perpendicular relationship relative to the blade wiping edge, the auxiliary guiding grooves being in a generally proximate relationship relative to the main guiding groove adjacent the groove second position and diverging away from each other in a direction leading towards the blade wiping edge.

The present invention also relates to a squeegee for allowing a liquid to be wiped-off a surface, the squeegee comprising a squeegee handle and a wiping blade attached to the handle, an absorbing means for absorbing at least a portion of the liquid having being wiped from the surface by the wiping blade; an attachment means for attaching the absorbing means to the squeegee adjacent the wiping blade so as to allow the absorbing means to absorb the liquid; and a guiding means in fluid communication with both the wiping blade and the absorbing means for guiding the liquid from the wiping blade to the absorbing means. Preferably, the attachment means is a releasable attachment means for releasably attaching the absorbing means to the squeegee.

Other objects and advantages of the present invention will become apparent from a careful reading of the detailed description provided herein, with appropriate reference to the accompanying drawings.

BRIEF DESCRIPTION OF THE DRAWINGS

Embodiments of the present invention will now be disclosed, by way of example, in reference to the following drawings in which.

DETAILED DESCRIPTION OF THE PREFERRED EMBODIMENTS

With reference to the annexed drawings the preferred embodiments of the present invention will be herein described for indicative purposes and by no means as of limitation.

Figure 1:
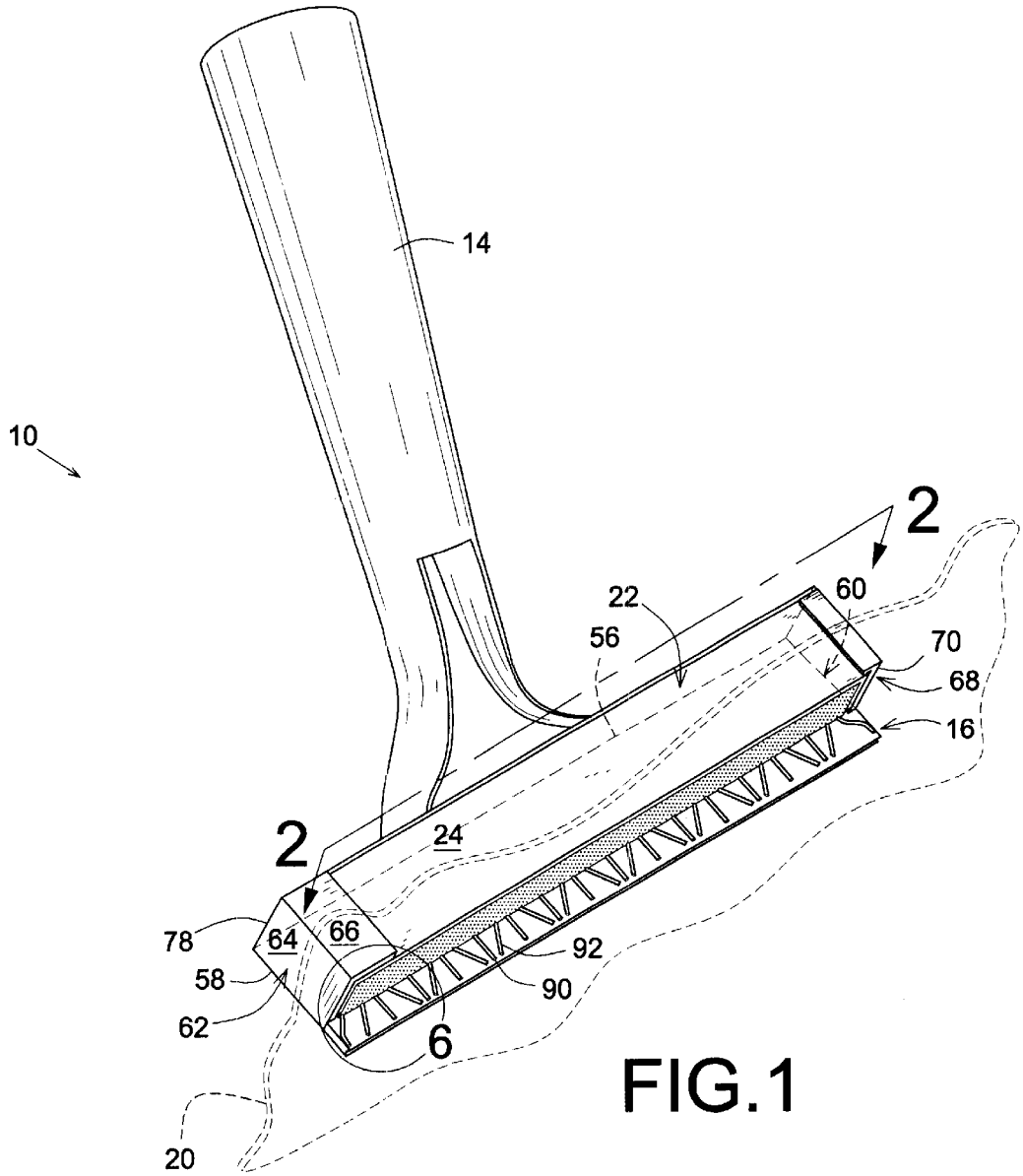
FIG. 1, in a perspective view, illustrates a squeegee having a squeegee implement in accordance with an embodiment of the present invention attached thereto.

Referring to FIG. 1, there is shown a squeegee implement 10 in accordance with an embodiment of the present invention. The squeegee implement 10 is attachable to a conventional squeegee. The conventional squeegee typically includes a squeegee handle 14 and a wiping blade 16. Although the wiping blade 16 is shown as being attached to the squeegee handle 14 through the use of a specific structure throughout the figures, it should be understood that the wiping blade 16 could be attached to the handle 14 through other structural connections without departing from the scope of the present invention. The squeegee allows a liquid schematically illustrated by arrows 18 to be wiped-off a surface 20.

Inasmuch as the present invention can be retro-fittable onto a conventional squeegee the following description refers to an implement for attachment to a conventional squeegee. It should however be understood that the present invention could also be in an integral part of a squeegee structure. Hence, the present invention relates both to an implement retro-fittable on a squeegee and to a squeegee incorporating novel features.

The squeegee or squeegee implement 10 includes an absorbing means for absorbing at least a portion of, preferably most of, the liquid 18 being wiped from the surface 20 by the wiping blade 16. The squeegee implement 10 also includes an attachment means for attaching the absorbing means to the squeegee adjacent the wiping blade 16 so as to allow the absorbing means to absorb the liquid 18. The squeegee implement 10 further includes a guiding means, in fluid communication with both the wiping blade 16 and the absorbing means, for guiding the liquid 18 from the wiping blade 16 to the absorbing means.

The absorbing means typically includes an absorbent component 22 made out of an absorbent material. The absorbent material is typically a spongious material although other types of materials could be used without departing from the scope of the present invention. The absorbent component 22 defines an absorbent component outer surface. A generally liquid impervious shell 24 is preferably attached to a section of the absorbent component outer surface. The shell 24 is typically made out of a substantially rigid material such as a suitable polymeric resin.

The absorbent component 22 typically has a generally parallelepiped-shaped configuration defining an absorbent component first main surface 26, an absorbent component second main surface 28, an absorbent component first auxiliary surface 30, an absorbent component second auxiliary surface 32, an absorbent component first side surface 34 and an absorbent component second side surface 36. It should however be understood that the absorbent component 22 could have other configurations without departing from the scope of the present invention.

Figure 2:
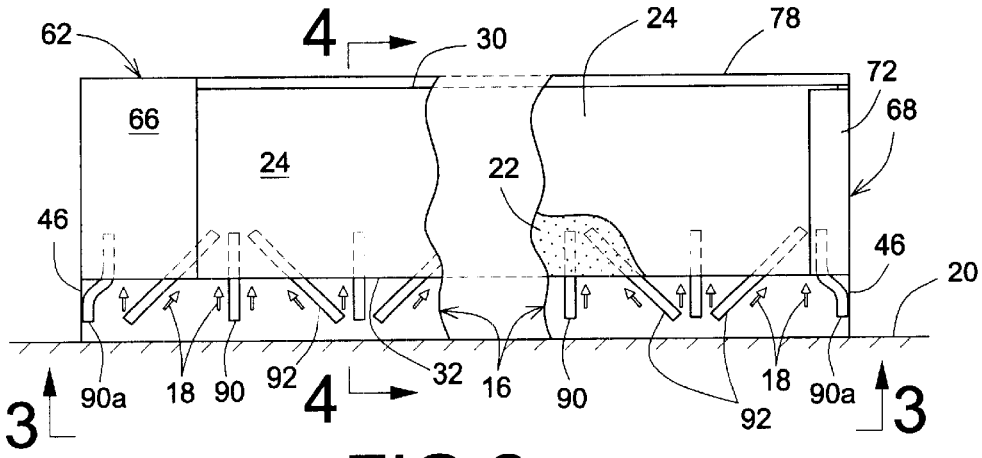
FIG. 2, in a rear elevational view, illustrates the squeegee and squeegee implement shown in FIG. 1.
Figure 6:
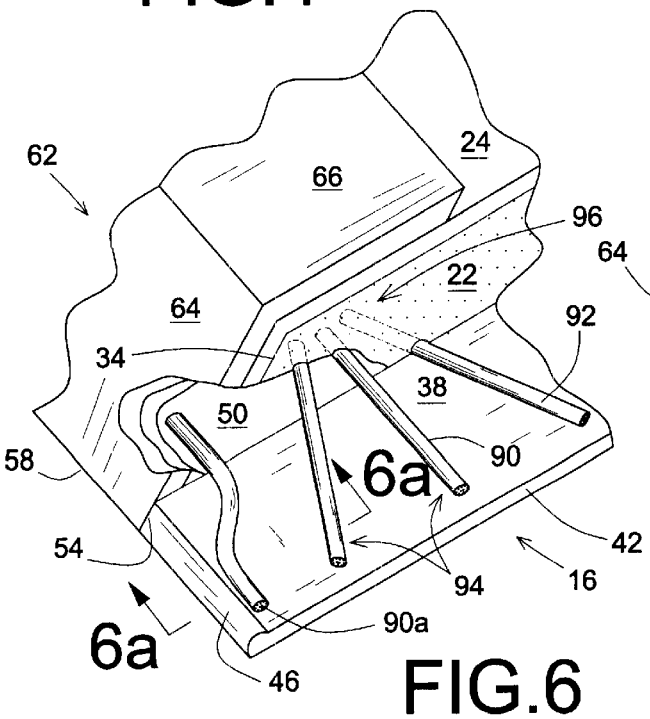
FIG. 6, in a partial perspective view taken along line 6 of FIG. 1 with sections taken out, illustrates a guiding structure part of a squeegee implement in accordance with an embodiment of the present invention.
Figure 7:
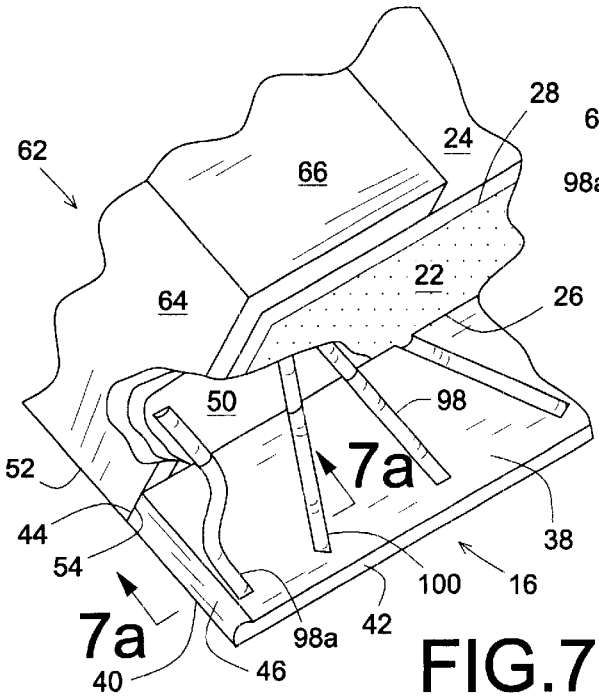
FIG. 7, in a partial perspective view with sections taken out, illustrates a guiding structure in accordance with an alternative embodiment of the present invention.

As illustrated more specifically in FIGS. 2, 6 and 7, the wiping blade 16 typically has a generally elongated, rectangular and flat configuration. The wiping blade 16 typically defines a blade first main surface 38, a blade second main surface 40, a blade the wiping edge 42, an opposed blade attachment edge 44, and a pair of blade side edges 46 (only one of which is shown in FIGS. 6 and 7). It should be understood that the wiping blade 16 could have other configurations such as a curved configuration, a tapered configuration or any other suitable configuration without departing from the scope of the present invention.

The attachment means typically includes a retaining structure attached to the squeegee intermediate the handle 14 and the wiping blade 16. The retaining structure is configured and sized for retaining at least a portion of the absorbent component 22.

The retaining structure defines a retaining structure main wall 48. The retaining structure main wall 48 typically has a generally rectangular and flat configuration defining a main wall first surface 50, a main wall second surface 52, a main wall first attachment edge 54, an opposed main wall second attachment edge 56, a main wall first side edge 58 and an opposed main wall second side edge 60.

As shown more specifically FIGS. 6 and 7, the blade attachment edge 44 is preferably attached to the main wall first attachment edge 54 so that the wiping blade 16 and the adjacent section of the retaining structure main wall 48 extend in a generally coplanar relationship relative to each other.

In an embodiment of the invention shown in FIGS. 1 through 3, 6 and 7, the retaining structure further includes a retaining bracket 62 extending from the retaining structure main wall 48. The retaining bracket 62 is configured and sized for frictionally retaining the absorbent component 22 against the main wall first surface 50.

The retaining bracket 62 typically has a generally L-shaped configuration defining a bracket first leg 64 and a generally perpendicular bracket second leg 66. The bracket first leg 64 typically extends generally perpendicularly from the main wall first surface 50 adjacent the main wall first side edge 58. The retaining bracket 62 is configured and sized so that the absorbent component 22 is frictionally retained against the retaining structure main wall 48 with at least a portion of the absorbent component first main surface 26 frictionally abutting against the main wall first surface 50 and at least a portion of the absorbent component second main surface 28 frictionally abutting against the bracket second leg 66.

Figure 3:
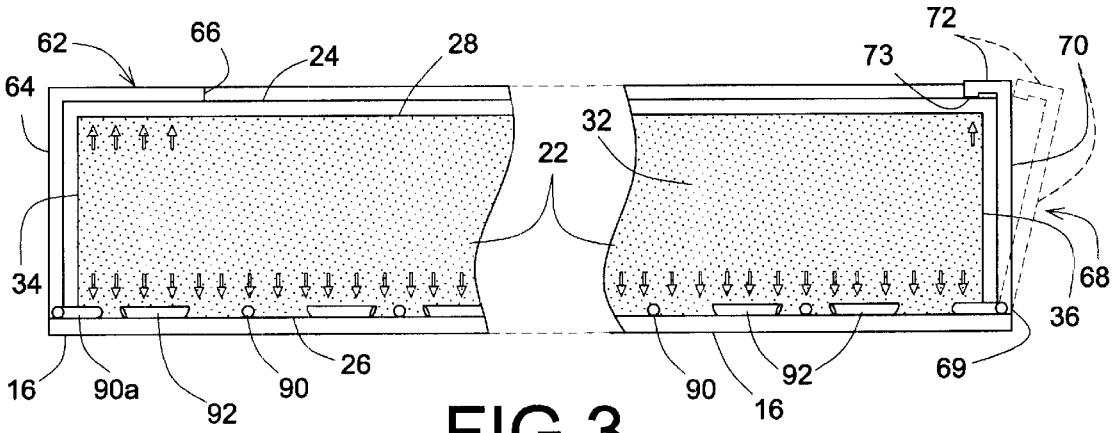
FIG. 3, in a longitudinal cross-sectional view taken along line 3—3 of FIG. 2, illustrates some of the components of the squeegee and squeegee implement shown in FIGS. 1 and 2.

As illustrated more specifically in FIGS. 1 through 3, in at least one embodiment of the invention, the retaining structure preferably further includes a retaining door 68. The retaining door 68 typically has a generally L-shaped configuration defining a door first leg 70 and a generally perpendicular door second leg 72. The door first leg 70 is pivotally attached to the retaining structure main wall 48 adjacent the main wall second side edge 60 so as to be pivotable between a door open configuration wherein the door first leg 70 is in an angled relationship relative to the retaining structure main wall 48 and a door closed configuration wherein the door first leg 70 is in a generally perpendicular relationship relative to the retaining structure main wall 48.

The retaining door 68 is configured and sized so that when the retaining door 68 is in the door open configuration it allows insertion of the absorbent component 22 in the retaining structure. The retaining door 68 is also configured and sized so that when the retaining door 68 is in the door closed configuration and the absorbent component 22 is frictionally retained in the retaining structure, at least a portion of the absorbent component first main surface 26 frictionally contacts the main wall first surface 50 and at least a portion of the absorbent component second main surface 28 frictionally contacts the door second leg 72.

As illustrated more specifically in FIG. 3, the retaining door 68 is preferably provided with a door biasing means mechanically coupled thereto for biasing the door 68 towards the door closed configuration. Typically, the door biasing means includes a resilient hinge 69 between the door first leg 70 and the main wall second side edge 60. The resilient hinge is typically made out of a suitable resilient polymeric resin. The retaining door 68 is also preferably further provided with a door releasable locking means operatively coupled thereto for releasably locking the door 68 in the door closed configuration. The door releasable locking means typically includes a locking tongue 73 extending integrally from the surface of the door second side leg 72 adapted to be put in contact with the absorbent component second main surface 28. The locking tongue 73 is adapted to increase the frictional contact between the door second side leg 72 and the absorbent component second main surface 28 so as to provide a releasable locking action.

In typical situations wherein the absorbent component 22 has a generally parallelepiped-shaped configuration, the shell 24 extends over the absorbent component first auxiliary surface 30 and at least a portion of the absorbent component second auxiliary surface 32, the absorbent component second main surface 28 and the absorbent component first and second side surfaces 34, 36. The free edges of the absorbent component first main surface 26, the absorbent component second main surface 28 and the absorbent component first and second side surfaces 34, 36 together define a shell free edge 25.

Figure 4:
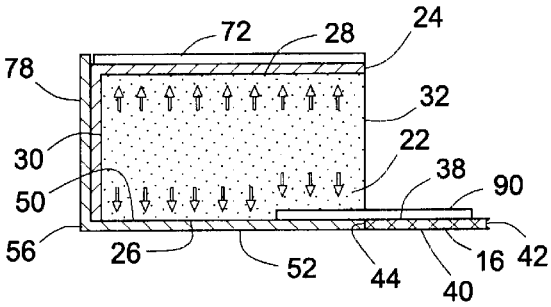
FIG. 4, and a transversal cross-sectional view taken along line 4—4 of FIG. 2, illustrates some of the components of the squeegee and squeegee implement shown in FIGS. 1 through 3.
Figure 5:
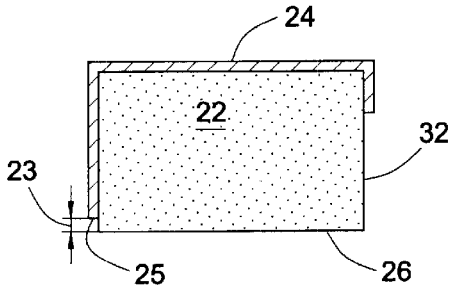
FIG. 5, in an elevational view, illustrates an absorbing sponge with its outer shell, the sponge and shell being part of a squeegee implement in accordance with an embodiment of the present invention.

FIG. 5 illustrates the absorbent component 22 in an uncompressed state. It should be noted that in the uncompressed state, the absorbent component 22 typically protrudes outwardly from the shell free edge 25 by an absorbent component-to-shell free edge spacing 23. As illustrated more specifically in FIGS. 3 and 4, the absorbent component 22 is typically sized so as to be in a generally compressed state at locations wherein the absorbent component 22 is frictionally retained the bracket and door second legs 66, 72 so as to increase the frictional retaining force between the absorbent component 22 and the retaining structure.

Figure 8:
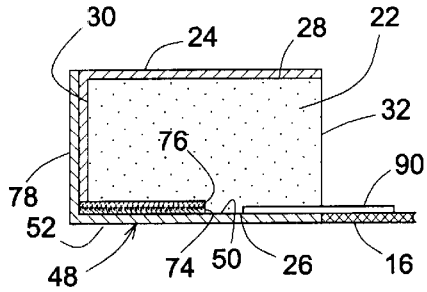
FIG. 8, in a partial transversal cross-sectional view similar to that of FIG. 4, illustrates yet another alternative embodiment of the present invention.

Referring now more specifically to FIG. 8, there is shown an alternative embodiment of the invention wherein the attachment means includes a first strip 74 of miniature hook-and-loop fiber secured to the main wall first surface 50 and a complementary second strip 76 of miniature hook-and-loop fiber secured to the absorbent component first main surface 26. The first and second strips 74, 76 of miniature hook-and-loop fiber are configured, sized and positioned so as to be substantially in register with each other when the absorbent component 22 is attached to the retaining structure main wall 50. The first and second strips 74, 76 of miniature hook-and-loop fiber are adapted to cooperate with each other for releasably securing the absorbent component 22 to the main wall first surface 50.

Figure 9:
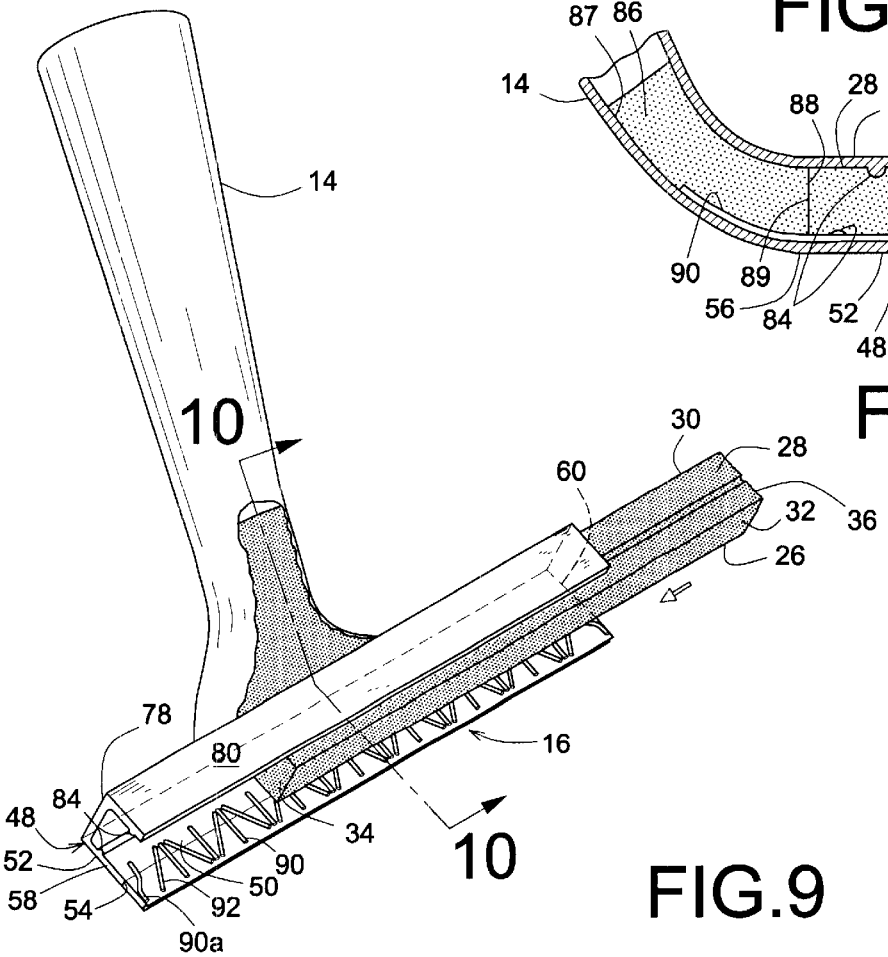
FIG. 9, in a perspective view, illustrates yet another alternative embodiment of the present invention, the embodiment being shown with the absorbing component being inserted thereinto.

As illustrated more specifically in FIGS. 1 and 9, in at least one embodiment of the invention, the squeegee implement 10 typically further includes a handle attachment wall 78 extending from the retaining structure main wall 48 adjacent the main wall second attachment edge 56. The handle 14 typically extends outwardly and at an angle from the handle attachment wall 78.

Figure 10:
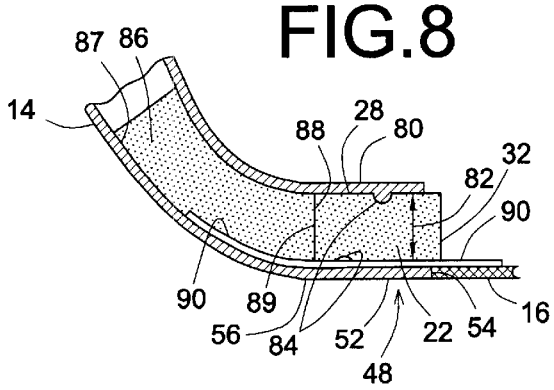
FIG. 10, in a partial transversal cross-sectional view taken along line 10—10 of FIG. 9, illustrates the relationship between some components of the embodiment shown in FIG. 9.

In yet another alternative embodiment of the invention illustrated more specifically in FIGS. 9 and 10, the retaining structure also includes a retaining structure auxiliary wall 80 extending from the handle attachment wall 78 so as to be in a generally spaced relationship relative to the retaining structure main wall 48 and so as to define a retaining structure channel or wall spacing 82 therebetween.

The absorbent component 22 is preferably slidably insertable in the retaining structure wall spacing 82 and frictionally retained between the retaining structure main and auxiliary walls 48, 80 once inserted in the retaining structure wall spacing 82. Typically, as shown in FIGS. 9 and 10, the retaining structure main and auxiliary walls 48, 80 preferably extend in generally parallel and spaced relationship relative to each other although they may extend in other configurations relative to each other without departing from the scope of the present convention.

As further illustrated in FIGS. 9 and 10, at least one retaining lip 84 preferably protrudes inwardly into the retaining structure wall spacing 82 from either one of the retaining structure main or auxiliary walls 48, 80. Typically, the retaining lip 84 extends from both the retaining structure main and auxiliary walls 48, 80. The retaining lips 84 are strategically positioned so as to increase the fictional contact with the absorbent component 22 and the retaining structure.

In at least one embodiment of the invention illustrated more specifically in FIG. 10, at least a section of the handle 14 has a generally hollow configuration defining a handle hollow section 87. With such embodiments, the absorbing means typically further includes absorbent insert 86 extending in the handle hollow section 87. The absorbent insert 86 is typically made of an absorbent material and is preferably in fluid communication with the absorbent component 22. Typically, the absorbent insert 86 and the absorbent component 22 are in contact with each other along contacting edges 88, 89 thereof.

Figure 6A:
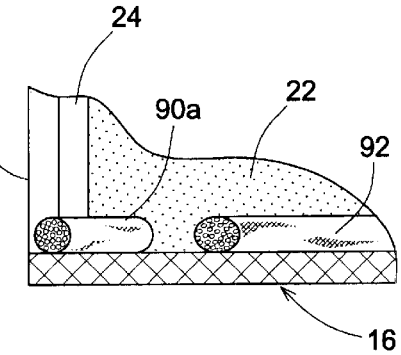
FIG. 6*a*, in a partial cross-sectional view taken along line 6*a*—6*a* of FIG. 6, illustrates the relationship between some of the components of the embodiment shown in FIG. 6.

The guiding means typically includes at least one generally elongated guiding protrusion extending from the wiping blade first main surface 38 between a position adjacent the blade wiping edge 42 and a position adjacent the absorbing means. As illustrated more specifically in FIGS. 6 and 6*a*, the guiding means preferably includes at least one main guiding protrusion 90 and at least a pair of auxiliary guiding protrusions 92. Typically, the guiding means includes a plurality of main and auxiliary guiding protrusion 90, 92 disposed along the wiping blade 16.

Each set of main and auxiliary guiding protrusions 90, 92 extends from a protrusion first position 94 located adjacent the blade wiping edge 42 to a protrusion second position 96 wherein the main and auxiliary guiding protrusions 90, 92 are sandwiched between the main wall first surface 50 and the absorbing component 22. Typically, the main guiding protrusion 90 extends in a generally perpendicular relationship relative to the blade wiping edge 42, with the sidemost guiding protrusions 90*a* being preferably slightly curved as to run along and as close as possible to the corresponding blade side edge 46. Also, typically, the auxiliary guiding protrusions 92 are in a generally proximate relationship relative to the main guiding protrusion 90 adjacent the protrusion second position 96 and diverge away from each other, preferably with an angle of approximately plus or minus forty-five (±45) degrees, in the direction leading towards the blade wiping edge 42. Obviously, any angle could be considered without departing from the scope of the present invention.

The main and auxiliary guiding protrusions 90, 92 protrude from the blade first main surface 38 sufficiently to enable the main and auxiliary guiding protrusions 90, 92 to act as guiding baffles for guiding the flow of the liquid 18 on the blade first main surface 38. Preferably, the main and auxiliary guiding protrusions 90, 92 are made out of a wick component so as to further providing a guiding capillary action.

Figure 7A:
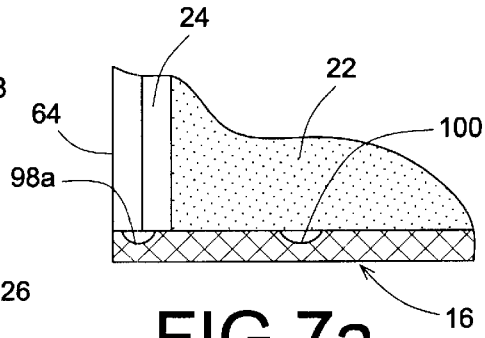
FIG. 7*a*, in a partial cross-sectional view with sections taken out, illustrates the relationship between some components of the embodiment shown in FIG. 7.

In an alternative embodiment of the invention shown in FIGS. 7 and 7*a,* the guiding means includes at least one main guiding groove 98 and at least a pair of auxiliary guiding grooves 100 formed in the blade first main surface 38 and preferably a section of the main wall first surface 50. Typically, in such an embodiment, the guiding means includes a plurality of main and auxiliary guiding grooves disposed along the wiping blade 16.

Typically, each set of main and auxiliary guiding grooves 98, 100 extends from a groove first position 94 adjacent the wiping edge 42 to a groove second position 96 wherein the main and auxiliary guiding grooves 98, 100 are in fluid communication with the absorbing means. Each main guiding groove 98 typically extends in a generally perpendicular relationship relative to the blade wiping edge 42, with the sidemost guiding grooves 98*a* being preferably slightly curved as to run along and as close as possible to the corresponding blade side edge 46. The auxiliary guiding grooves 100 typically extend in a generally proximate relationship relative to the main guiding groove 98 adjacent the groove second position 96 and diverge away from each other, preferably with an angle of approximately plus or minus forty-five (±45) degrees, in the direction leading towards the blade wiping edge 42.

Alternatively, the wick component of the guiding protrusions 90, 92 could also either be mounted inside respective grooves 98, 100 formed in the blade first main surface 38 and preferably a section of the main wall first surface 50 or be formed within the blade 16 and protrude out from the blade first main surface 38.

In use, an absorbent component 22 is first secured to the retaining structure. In situations wherein the embodiment shown in FIGS. 1 through 7*a* is used, the absorbent component 22 is secured by first pivoting, using material resiliency, the retaining door 68 towards its open configuration shown in phantom lines in FIG. 3. The absorbent component 22 is then slidably inserted so that the absorbent component first side edge 34 is positioned adjacent or abuttingly contacts the retaining bracket first leg 64. The absorbent component 22 is then pivoted so that the absorbent component first main surface 26 contacts the main wall first surface 50. The retaining door 68 is then, preferably resiliently, pivoted back towards the door closed configuration shown in full lines in FIGS. 1, 2 and 3.

With the retaining bracket and door second legs 66, 72 abutting against corresponding segments of the absorbing component second main surface 28, the absorbent component 22 is typically in a compressed state increasing the frictional contact between the absorbent component 22 and the retaining structure. The fictional contact between the absorbent component first surface 26 and of the retaining wall first main surface 50 combined with the fictional contact between the retaining bracket and door second legs 66, 72 and corresponding segments of the absorbing component second main surface 28 allow for the absorbent component 22 to be retained releasably and securely within the retaining structure.

When the embodiment shown in FIG. 8 is used, contact between the first and second strips 74, 76 of miniature hook-and-loop fiber is used for releasably and securely retaining the absorbent component 22 within the retaining structure. In situations wherein the embodiment shown in FIGS. 9 and 10 is used, the absorbent component 22 is slidably inserted laterally within the retaining structure wall spacing 82 between the retaining structure main and auxiliary walls 48, 80.

The rigid and impervious casing 24 prevents contact between the hands of the intended user and the spongious material of the absorbent component 22. In situations wherein a used absorbent component 22 is replaced by a new absorbent component 22, the used absorbent component 22 is merely pushed out of the retaining structure by the new one, again without requiring contact of the soiled absorbent component by the hands of the intended user In all embodiments, the use of a generally rigid casing or shell 24 facilitates manipulation of a typically generally resilient absorbent component 22. The shell 24 also prevents any accidental compression of the soiled absorbent component 22, thus preventing the absorbed dirty liquid from being squeezed out of the soiled absorbent component 22 and falling back on the surface 20 or any adjacent surface, especially when replacing the absorbent component 22 from the retaining structure.

Once the absorbent component 22 is properly inserted within the retaining structure, the handle 14 is grasped by the intended user and manipulated so that the wiping edge 42 of the wiping blade 16 contacts the surface 20. The squeegee component is then manipulated in a conventional manner to wipe the liquid 18 away from the surface 20. The guiding protrusions 90, 92 and/or grooves 98, 100 guide the liquid 18 being scraped by the wiping blade 16 towards the absorbent component 22. In the event where wick-type components are used or wherein the grooves 98, 100 are properly sized, a capillary effect favors movement of the liquid 18 towards the absorbent component 22.

The absorbent component 22 absorbs the liquid 18 preventing the latter from dripping or falling back onto the wiped surface 20 and/or other adjacent surfaces such as the window frame or furniture. Excess liquid within the absorbent component 22 may be transferred by absorption or capillary action to the absorbent insert 86 when the latter is provided. The absorbent insert 86 thus increases the overall volume of liquid that can be absorbed by the absorbing means.

Once the absorbent component 22 is soaked with liquid, when the liquid becomes dirty or when needed for any other reasons, the absorbent component 22 may be readily replaced through a set of ergonomical steps. The removal steps depend on the specific embodiment used and are substantially reversed to that hereinabove mentioned for installation of the absorbent component 22 within the retaining structure.

The use of a guiding means such as main and auxiliary guiding protrusions 90, 92 and/or grooves 98, 100 having angled relationships relative to each other allows the guiding protrusions 90, 92 and/or grooves 98, 100 to efficiently carry the liquid 18 being wiped by the blade 16 towards the absorbent component 22 regardless of the angular relationship between the blade longitudinal axis and the surface 20. In other words, the squeegee implement or squeegee 10 can be maneuvered in most directions on the surface 20 while still beneficiating from the guiding effect of the guiding structures for guiding the liquid 18 from the wiping blade 16 to the absorbent component 22. The surface 20 could be any inside surface such as a greenhouse window, a skylight window or the like.

Although the present squeegee implement has been described with a certain degree of particularity, it is to be understood that the disclosure has been made by way of example only and that present invention is not limited to the features of the embodiments described and illustrated herein, but includes all variations and modifications within the scope of the present invention as hereinafter claimed.

I claim:

1. An implement for attachment to a squeegee, said squeegee including a squeegee handle and a wiping blade attached to said handle, said squeegee allowing a liquid to be wiped-off a surface, said squeegee implement comprising:

an absorbing means for absorbing at least a portion of said liquid having being wiped from said surface by said wiping blade;

an attachment means for attaching said absorbing means to said squeegee adjacent said wiping blade so as to allow said absorbing means to absorb said liquid; and a guiding means in fluid communication with both the wiping blade and said absorbing means for guiding said liquid from said wiping blade to said absorbing means.

2. A squeegee implement as recited in claim 1, wherein said attachment means is a releasable attachment means for releasably attaching said absorbing means to said squeegee.

3. A squeegee implement as recited in claim 1, wherein said absorbing means includes an absorbent component made of an absorbent material.

4. A squeegee implement as recited in claim 3, wherein said absorbent material is a spongious material.

5. A squeegee implement as recited in claim 3, wherein said absorbent component defines an absorbent component outer surface and wherein a generally liquid impervious shell is attached to a section of said absorbent component outer surface.

6. A squeegee implement as recited in claim 5, wherein said shell is made out of a substantially rigid material.

7. A squeegee implement as recited in claim 3, wherein said attachment means includes a retaining structure attached to said squeegee intermediate said handle and said wiping blade, the retaining structure being configured and sized for retaining at least a portion of said absorbent component.

8. A squeegee implement as recited in claim 7, wherein said wiping blade has a generally elongated configuration defining a blade first main surface, a blade second main surface, a blade wiping edge, an opposed blade attachment edge and a pair of blade side edges, said retaining structure defining a retaining structure main wall, said retaining structure main wall having a generally flat configuration defining a main wall first surface, a main wall second surface, a main wall first attachment edge, an opposed main wall second attachment edge, a main wall first side edge and an opposed main wall second side edge, said blade attachment edge being attached to said main wall first attachment edge with said wiping blade and said retaining structure main wall in a generally coplanar relationship relative to each other.

9. A squeegee implement as recited in claim 8, further comprising a retaining bracket extending from said retaining structure main wall, said retaining bracket being configured and sized for frictionally retaining said absorbent component against said main wall first surface.

10. A squeegee implement as recited in claim 9, wherein said absorbent component has a generally parallelepiped-shaped configuration defining a absorbent component first main surface, an absorbent component second main surface, an absorbent component first auxiliary surface, an absorbent component second auxiliary surface, an absorbent component first side surface and an absorbent component second side surface;

said retaining bracket having a generally L-shaped configuration defining a bracket first leg and a generally perpendicular bracket second leg, said bracket first leg extending generally perpendicularly from said retaining structure main wall adjacent said main wall first side edge, said retaining bracket being configured and sized so that said absorbent component is frictionally retained by said retaining structure with said absorbent component first main surface frictionally abutting against said main wall first surface and said bracket second leg frictionally abutting against said absorbent component second main surface.

11. A squeegee implement as recited in claim 10, further comprising a retaining door, said retaining door having a generally L-shaped configuration defining a door first leg and a generally perpendicular door second leg, said door first leg being pivotally attached to said retaining structure main wall adjacent said main wall second side edge so as to be pivotable between a door open configuration wherein said door first leg allows insertion of said absorbent component in said retaining structure and a door closed configuration wherein said door first leg prevents withdrawal of said absorbent component from said retaining structure, said retaining door being configured and sized so that when said retaining door is in said door closed configuration and said absorbent component is frictionally retained in said retaining structure at least a portion of said absorbent component first main surface frictionally contacts said main wall first surface and at least a portion of said absorbent component second main surface frictionally contacts said door second leg.

12. A squeegee implement as recited in claim 11, wherein said absorbent component is sized so as to be in a generally compressed state at locations wherein said absorbent component is frictionally retained by said door and bracket second legs.

13. A squeegee implement as recited in claim 8, wherein said absorbent component has a generally parallelepiped-shaped configuration defining an absorbent component first main surface, an absorbent component second main surface, an absorbent component first auxiliary surface, an absorbent component second auxiliary surface, an absorbent component first side surface and an absorbent component second side surface;

said attachment means including a first strip of miniature hook-and-loop fiber secured to said main wall first surface and a second strip of miniature hook-and-loop fiber secured to said absorbent component first main surface, said first and second strips of miniature hook-and-loop fiber being configured, sized and positioned so as to be substantially in register with each other when said absorbent component is attached to said retaining structure main wall whereby said first and second strips of miniature hook-and-loop fiber cooperate with each other for releasably securing said absorbent component to said main wall first surface.

14. A squeegee implement as recited in claim 8, further comprising a handle attachment wall extending from said retaining structure main wall adjacent said main wall second attachment edge, said handle extending outwardly from said handle attachment wall.

15. A squeegee implement as recited in claim 14, wherein said retaining structure also includes a retaining structure auxiliary wall extending from said handle attachment wall so as to be in a generally spaced relationship relative to said retaining structure main wall and to define a retaining structure wall spacing therebetween, said absorbent component being slidably insertable in said retaining wall spacing and frictionally retained between said retaining structure main and auxiliary walls once inserted in said retaining structure wall spacing.

16. A squeegee implement as recited in claim 15, further comprising a retaining lip extending inwardly from either one of said retaining structure main or auxiliary wall so as to increase the frictional contact with said absorbent component.

17. A squeegee implement as recited in claim 3, wherein at least a section of said handle has a generally hollow configuration defining a handle hollow section and wherein said absorbing means further includes an absorbent insert inserted into said handle hollow section, said absorbent insert being made of an absorbent material and being in fluid communication with said absorbent component.

18. A squeegee implement as recited in claim 1, wherein said guiding means includes a generally elongated guiding protrusion extending from said blade towards said absorbing means.

19. A squeegee implement as recited in claim 18, wherein said guiding protrusion is made out of a wick component for providing a capillary action.

20. A squeegee implement as recited in claim 19, wherein said wiping blade has a generally elongated, rectangular and flat configuration defining a blade first main surface, a blade second main surface, a blade wiping edge, an opposed blade attachment edge and a pair of blade side edges and wherein said attachment means includes a retaining structure defining a retaining structure main wall, said retaining structure main wall having a generally rectangular and flat configuration defining a main wall first surface, a main wall second surface, a main wall first attachment edge, an opposed main wall second attachment edge, a main wall first side edge and an opposed main wall second side edge, said blade attachment edge being attached to said main wall first attachment edge with said wiping blade and said retaining structure main wall in a generally coplanar relationship relative to each other, said wick component being secured to both said blade first main surface and said main wall first surface so as to extend from a wick first position located adjacent said blade wiping edge to a wick second position wherein said wick component is sandwiched between said main wall first surface and said absorbing means.

21. A squeegee implement as recited in claim 1, wherein said wiping blade has a generally elongated configuration defining a blade first main surface, a blade second main surface, a blade wiping edge, an opposed blade attachment edge and a pair of blade side edges, said attachment means includes a retaining structure defining a retaining structure main wall, said retaining structure main wall having a generally flat configuration defining a main wall first surface, a main wall second surface, a main wall first attachment edge, an opposed main wall second attachment edge, a main wall first side edge and an opposed main wall second side edge, said blade attachment edge being attached to said main wall first attachment edge with said wiping blade and said retaining structure main wall in a generally coplanar relationship relative to each other;

wherein said guiding means includes a main guiding protrusion and a pair of auxiliary guiding protrusions, said main and auxiliary guiding protrusions extending from a protrusion first position located adjacent said blade wiping edge to a protrusion second position wherein said main and auxiliary guiding protrusions are sandwiched between said main wall first surface and said absorbing means, said main guiding protrusion extending in a generally perpendicular relationship relative to said blade wiping edge, said auxiliary guiding protrusions being in a generally proximate relationship relative to said main guiding protrusion adjacent said protrusion second position and diverging away from each other in a direction leading towards said blade wiping edge.

22. A squeegee implement as recited in claim 21, wherein said main and auxiliary guiding protrusions defining a pair of sidemost guiding protrusions adjacent said pair of blade side edges, each one of said sidemost guiding protrusions runs along a corresponding blade side edge.

23. A squeegee implement as recited in claim 1, wherein said wiping blade has a generally elongated configuration defining a blade first main surface, a blade second main surface, a blade wiping edge, an opposed blade attachment edge and a pair of blade side edges, said attachment means includes a retaining structure defining a retaining structure main wall, said retaining structure main wall having a generally flat configuration defining a main wall first surface, a main wall second surface, a main wall first attachment edge, an opposed main wall second attachment edge, a main wall first side edge and an opposed main wall second side edge, said blade attachment edge being attached to said main wall first attachment edge with said wiping blade and said retaining structure main wall in a generally coplanar relationship relative to each other;

wherein said guiding means includes a main guiding groove and a pair of auxiliary grooves formed on said blade first main surface, said main and auxiliary guiding grooves extending from a groove first position located adjacent said blade wiping edge to a groove second position wherein said main and auxiliary guiding grooves are in fluid communication with said absorbing means, said main guiding groove extending in a generally perpendicular relationship relative to said blade wiping edge, said auxiliary guiding grooves being in a generally proximate relationship relative to said main guiding groove adjacent said groove second position and diverging away from each other in a direction leading towards said blade wiping edge.

24. A squeegee for allowing a liquid to be wiped-off a surface, said squeegee comprising:

a squeegee handle and a wiping blade attached to said handle, an absorbing means for absorbing at least a portion of said liquid having being wiped from said surface by said wiping blade;

an attachment means for attaching said absorbing means to said squeegee adjacent said wiping blade so as to allow said absorbing means to absorb said liquid; and a guiding means in fluid communication with both the wiping blade and said absorbing means for guiding said liquid from said wiping blade to said absorbing means.

25. A squeegee as recited in claim 24, wherein said attachment means is a releasable attachment means for releasably attaching said absorbing means to said squeegee.

26. A squeegee as recited in claim 25, wherein said wiping blade has a generally elongated configuration defining a blade first main surface, a blade second main surface, a blade wiping edge, an opposed blade attachment edge and a pair of blade side edges, said attachment means includes a retaining structure defining a retaining structure main wall, said retaining structure main wall having a generally flat configuration defining a main wall first surface, a main wall second surface, a main wall first attachment edge, an opposed main wall second attachment edge, a main wall first side edge and an opposed main wall second side edge, said blade attachment edge being attached to said main wall first attachment edge with said wiping blade and said retaining structure main wall in a generally coplanar relationship relative to each other.

* * * * *